United States Patent [19]

Lewtas

[11] Patent Number: 4,661,122

[45] Date of Patent: Apr. 28, 1987

[54] MIDDLE DISTILLATE COMPOSITIONS WITH IMPROVED COLD FLOW PROPERTIES

[75] Inventor: Kenneth Lewtas, Wantage, United Kingdom

[73] Assignee: Exxon Research & Engineering Co., Florham Park, N.J.

[21] Appl. No.: 713,023

[22] Filed: Mar. 18, 1985

[30] Foreign Application Priority Data

Mar. 22, 1984 [GB] United Kingdom ..... 8407403
Aug. 10, 1984 [GB] United Kingdom ..... 8420436

[51] Int. Cl.[4] ..... C10L 1/18

[52] U.S. Cl. ..... 44/70; 44/56; 44/62

[58] Field of Search ..... 44/62, 70, 56; 585/13, 585/14

[56] References Cited

U.S. PATENT DOCUMENTS

| | | | |
|---|---|---|---|
| 2,655,479 | 10/1953 | Munday et al. | 252/56 |
| 2,824,840 | 2/1958 | Cashman et al. | 252/56 |
| 3,048,479 | 8/1962 | Ilnyckyj et al. | 44/62 |
| 3,252,771 | 5/1966 | Clough et al. | 44/62 |
| 3,413,103 | 11/1968 | Young et al. | 44/62 |
| 3,726,653 | 4/1973 | Van der Meij et al. | 44/62 |
| 3,773,478 | 11/1973 | Feldman | 44/70 |
| 3,832,150 | 8/1974 | Feldman | 44/62 |
| 3,911,916 | 6/1976 | Ilnyckyj et al. | 44/62 |
| 4,153,422 | 5/1979 | Wisotsky | 44/62 |
| 4,153,423 | 5/1979 | Wisotsky | 44/62 |
| 4,153,424 | 5/1979 | Wisotsky | 44/62 |
| 4,175,926 | 11/1979 | Wisotsky | 44/62 |
| 4,201,554 | 5/1980 | Vartanian | 44/62 |
| 4,210,424 | 7/1980 | Feldman et al. | 44/62 |
| 4,211,534 | 7/1980 | Feldman | 44/62 |
| 4,261,703 | 4/1981 | Tack et al. | 44/62 |
| 4,365,973 | 12/1982 | Irish | 44/62 |

FOREIGN PATENT DOCUMENTS

| | | |
|---|---|---|
| 0061894A2 | 10/1982 | European Pat. Off. . |
| WO83/03615 | 10/1983 | Japan . |
| 573364 | 11/1945 | United Kingdom . |
| 1263152 | 2/1972 | United Kingdom . |
| 1469016 | 3/1977 | United Kingdom . |
| 1542295 | 3/1979 | United Kingdom . |
| 2023645B | 10/1982 | United Kingdom . |

OTHER PUBLICATIONS

The Institute of Petroleum, "New Laboratory Test for Predicting Low-Temperature Operability of Diesel Fuels" by T. Coley, L. F. Rutishauser, and H. M. Ashton., vol. 52, No. 510-Jun. 1966. (Esso Research Ltd, Abingdon, Berks).

*Primary Examiner*—William R. Dixon, Jr.
*Assistant Examiner*—Margaret B. Medley
*Attorney, Agent, or Firm*—F. T. Johmann; R. A. Maggio

[57] ABSTRACT

The low temperature properties of a distillate petroleum fuel oil boiling in the range 120° C. to 500° C. and having a final boiling point above 370° C., are improved particularly the lowering of the cloud point by the addition of a polymer or copolymer having at least 25 wt. % of n-alkyl groups of average number of carbon atoms from 14 to 18 with no more than 10 wt. % containing less than 14 carbon atoms and no more than 10 wt. % containing more than 14 carbon atoms.

17 Claims, No Drawings

MIDDLE DISTILLATE COMPOSITIONS WITH IMPROVED COLD FLOW PROPERTIES

Mineral oils containing paraffin wax therein have the characteristic of becoming less fluid as the temperature of the oil decreases. This loss of fluidity is due to the crystallization of the wax into plate-like crystals which eventually form a spongy mass entrapping the oil therein. When pumped these crystals, if they can be moved, block fuel lines and filters.

It has long been known that various additives act as wax crystal modifiers when blended with waxy material oils. These compositions modify the size and shape of wax crystals and reduce the adhesive forces between the wax and oil in such a manner as to permit the oil to remain fluid at a lower temperature.

Various pour point depressants have been described in the literature and several of these are in commercial use. For example, U.S. Pat. No. 3,048,479 teaches the use of copolymers of ethylene and $C_3$–$C_5$ vinyl esters, e.g. vinyl acetate, as pour depressants for fuels, specifically heating oils, diesel and jet fuels. Hydrocarbon polymeric pour depressants based on ethylene and higher alpha-olefins, e.g. propylene, are also known. U.S. Pat. No. 3,961,916 teaches the use of a mixture of copolymers, one of which is a wax crystal nucleator and the other a growth arrestor to control the size of the wax crystals.

Similarly United Kingdom Pat. No. 1263152 suggests that the size of the wax crystals may be controlled by using a copolymer having a lower degree of side chain branching.

It has also been proposed in for example United Kingdom Pat. No. 1469016 that the copolymers of di-n-alkyl fumarates and vinyl acetate which have previously been used as pour depressants for lubricating oils may be used as co-additives with ethylene/vinyl acetate copolymers in the treatment of distillate fuels with high final boiling points to improve their low temperature flow properties. According to United Kingdom Pat. No. 1469016 these polymers may be $C_6$ to $C_{18}$ alkyl esters of unsaturated $C_4$ to $C_8$ dicarboxylic acids particularly lauryl fumarate; lauryl-hexadecyl fumarate. Typically the materials used were polymers made from (i) vinyl acetate and mixed-alcohol fumarate esters with an average of about 12.5 carbon atoms (Polymer A in United Kingdom Pat. No. 1469016), (ii) vinyl acetate and mixed-fumarate esters with an average of about 13.5 carbon atoms (Polymer E in United Kingdom Pat. No. 1469016) and (iii) copolymers of $C_{12}$ di-n-alkyl fumarates and $C_{16}$ methacrylates or $C_{16}$ di-n-alkyl fumarates and $C_{12}$ methacrylates all of which were ineffective as additives for distillate fuel.

United Kingdom Pat. No. 1542295 shows in its Table II that Polymer B which is a homopolymer of n-tetradecylacrylate and Polymer C which is a copolymer of hexadecyl acrylate and methyl methacrylate are by themselves ineffective as additives in the narrow boiling type of fuel with which that patent is concerned.

PCT Patent Publication No. WO 83/03615 discloses the use of copolymers of certain olefines and maleic anhydride esterified with certain alcohols in admixture with low molecular weight polyethylene in waxy fuels believed to be of relatively low final boiling point and shows the copolymers themselves to be ineffective additives.

With the increasing diversity in distillate fuels and the need to maximise the yield of this petroleum fraction fuels have emerged which cannot be adequately treated with conventional additives such as ethylene-vinyl acetate copolymers. One way of increasing the yield of distillate fuel is to use more of the Heavy Gas Oil fraction (HGO) in blends with distillate cuts or to cut-deeper by increasing the Final Boiling Point (FBP) of the fuel to for example above 370° C. It is with this type of fuel especially fuels with 90% boiling points above 350° C. and final boiling points above 370° C. that the present invention is concerned.

The copolymers of ethylene and vinyl acetate which have found widespread use for improving the flow of the previously widely available distillate fuels have not been found to be effective in the treatment of these fuels described above. Furthermore use of mixtures as illustrated in United Kingdom Pat. No. 1469016 have not been found to be as effective as the additives of the present invention.

In addition there is at times a need to lower what is known as the cloud point of distillate fuels, the cloud point being the temperature at which the wax begins to crystallise out from the fuel as it cools these high final boiling point fuels. This temperature is generally measured using a differential scanning calorimeter.

U.S. Pat. No. 3252771 relates to the use of polymers of $C_{16}$ to $C_{18}$ alpha olefins prepared by polymerising olefin mixtures that predominate in normal $C_{16}$ to $C_{18}$ alpha-olefines with aluminium trichloride/alkyl catalysts as pour point and cloud point depressants in distillate fuels of low final boiling point and easy to treat types available in the United States in the early 1960's.

We have found that very specific copolymers are effective in controlling the size of the wax crystals forming in these hitherto difficult to treat fuels which boil in the range 120° C. to 500° C. and have a Final Boiling Point (FBP) above 370° C. to allow filterability in both the Cold Filter Plugging Point Test (CFPPT) (to correlate with diesel vehicle operability) and the Programmed Cooling Test (PCT) (to correlate with Heating Oil operation at low temperatures). We have also found that the copolymers are effective in lowering the cloud point of many of these fuels over the entire range of distillate fuels.

Specifically we have found that polymers or copolymers containing at least 25 wt.% of n-alkyl groups containing an average of from 14 to 18 carbon atoms and no more than 10% (w/w) of said alkyl group containing fewer than 14 carbon atoms and no more than 10% (w/w) of the alkyl groups contain more than 18 carbon atoms are extremely effective additives. Copolymers of di-n-alkyl fumarates and vinyl acetate are the preferred copolymers and we have found that using fumarates made from single alcohols or binary mixtures of alcohols is particularly effective. When mixtures of alcohols are used we prefer to mix the alcohols prior to the esterification step rather than are mixed fumarates each obtained from single alcohols.

Generally, we find that the average carbon number of the long n-alkyl groups in the polymer or copolymer should lie between 14 and 17 for most of such fuels found in Europe whose Final Boiling Points are in the ranges of 370° C. to 410° C. Such fuels generally have Cloud Points in the range of −5° C. to +10° C. If the Final Boiling Point is increased or the heavy gas oil component of the fuel is increased such as in fuel found in warmer climates, e.g. Africa, India, S.E. Asia etc. the average carbon number of the said alkyl group can be increased to somewhere between 16 and 18. These latter fuels may have Final Boiling Points in excess of 400° C. and Cloud Points above 10° C.

The preferred polymers or copolymers used as the additives of the invention comprise at least 10% (w/w) of a mono of di-n-alkyl ester of a mono-ethylenically unsaturated $C_4$ to $C_8$ mono or dicarboxylic acid (or anhydride) in which the average number of carbon atoms in the n-alkyl groups is from 14 to 18. The said mono or di-n-alkyl ester containing no more than 10% (w/w) based on the total alkyl groups of alkyl groups containing less than 14 carbon atoms and no more than 10% w/w) of alkyl groups containing more than 18 carbon atoms. These unsaturated esters are preferably co-polymerized with at least 10% (w/w) of an ethylene-unsaturated ester such as those described in the Coadditives Section hereof, for example vinyl acetate. Such polymers have a number average molecular weight in the range of 1000 to 100,000, preferably 1000 to 30,000 as measured, for example, by Vapour Phase Osmometry.

The mono/dicarboxylic acid esters useful for preparing the polymer can be represented by the formula:

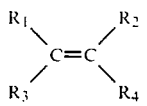

wherein $R_1$ and $R_2$ are hydrogen or a $C_1$ to $C_4$ alkyl group, e.g. methyl, $R_3$ is a $C_{14}$ to $C_{18}$ (average) CO.O or $C_{14}$ to $C_{18}$ (average) O.CO, where the chains are n-alkyl groups, and $R_4$ is hydrogen, $R_2$ or $R_3$.

The dicarboxylic acid mono or di-ester monomers may be copolymerised with various amounts, e.g., 0 to 70 mole %, of other unsaturated monomers such as esters. Such other esters include short chain alkyl esters having the formula:

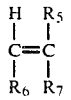

where $R_5$ is hydrogen or a $C_1$ to $C_4$ alkyl group, $R_7$ is

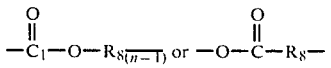

where $R_8$ is a $C_1$ to $C_5$ alkyl group branched or unbranched, and $R_7$ is $R_6$ or hydrogen. Examples of these short chain esters are methacrylates, acrylates, fumarates (and maleates) and vinyl esters. More specific examples include methyl methacrylate, isopropenyl acrylate and isobutyl acrylate. The vinyl esters such as vinyl acetate and vinyl propionate being preferred.

Our preferred polymers contain from 40 to 60% (mole/mole) of $C_{14}$ to $C_{18}$ (average) dialkyl fumarate and 60 to 40% (mole/mole) of vinyl acetate.

The ester polymers are generally prepared by polymerising the ester monomers in a solution of a hydrogen solvent such as heptane, benzene, cyclohexane, or white oil, at a temperature generally in the range of from 20° C. to 150° C. and usually promoted with a peroxide or azo type catalyst such as benzoyl peroxide or azodiisobutyronitrile under a blanket of an inert gas such as nitrogen or carbon dioxide in order to exclude oxygen. The polymer may be prepared under pressure in an autoclave or by refluxing.

The additives of the present invention are particularly effective when used in combination with other additives previously proposed for improving the cold flow properties of distillate fuels generally, but are found to be particularly effective in the type of fuels with which the present invention is concerned.

Coadditives

The additives of this invention may be used with ethylene unsaturated ester copolymer flow improvers. The unsaturated monomers which may be copolymerized with ethylene, include unsaturated mono and diesters of the general formula:

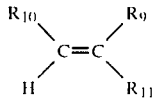

wherein $R_{10}$ is hydrogen or methyl; $R_9$ is a $—OOCR_{12}$ group wherein $R_{12}$ is hydrogen or a $C_1$ to $C_{28}$, more usually $C_1$ to $C_{17}$, and preferably a $C_1$ to $C_8$, straight or branched chain alkyl group; $R_9$ is a $—COOR_{12}$ group wherein $R_{12}$ is as previously described but is not hydrogen and $R_{11}$ is hydrogen or $—COOR_{12}$ as previously defined. The monomer, when $R_{10}$ and $R_{11}$ are hydrogen and $R_9$ is $—OOCR_{12}$

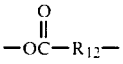

includes vinyl alcohol esters of $C_1$ to $C_{29}$, more usually $C_1$ to $C_{18}$, monocarboxylic acids, and preferably $C_2$ to $C_5$ monocarboxylic acids. Examples of vinyl esters which may be copolymerised with ethylene include vinyl acetate, vinyl propionate and vinyl isobutyrate, vinyl acetate being preferred. It is also preferred that the copolymers contain from 10 to 40 wt.% of the vinyl ester more preferably from 25 to 35 wt.% vinyl ester. Mixtures of two copolymers such as those described on U.S. Pat. No. 3961916 may also be used. These copolymers preferably have a number average molecular weight as measured by vapour phase osmometry (VPO) of 1000 to 6000 preferably 1000 to 4000.

The additives of the present invention may also be used in combination with polar compounds, either ionic or nonionic, which have the capability of acting as wax crystal growth inhibitors. Polar nitrogen containing compounds have been found to be especially effective and these are generally the $C_{30}$–$C_{300}$ preferably $C_{50}$–$C_{150}$ amine salts and/or amides formed by reaction of at least one molar proportion of hydrocarbyl substituted amines with a molar proportion of hydrocarbyl acid having 1–4 carboxylic acid groups or their anhydrides; ester/amides may also be used. These nitrogen compounds are described in U.S. Pat. No. 4,211,534. Suitable amines are long chain $C_{12}$–$C_{40}$ primary, secondary, tertiary or quaternary amines or mixtures thereof but shorter chain amines may be used provided the resulting nitrogen compound is oil soluble and therefore they normally contain about 30 to 300 total carbon atoms. The nitrogen compound should also have at least one straight chain $C_8$–$C_{40}$ alkyl segment.

Examples of suitable amines include tetradecyl amine, cocoamine, hydrogenated tallow amine and the like. Examples of secondary amines include dioctaldecyl amine, methyl-behenyl amine and the like. Amine mixtures are also suitable and many amines derived from natural materials are mixtures. The preferred amine is a secondary hydrogenated tallow amine of the formula $HNR_1R_2$ wherein $R_1$ and $R_2$ are alkyl groups derived from hydrogenated tallow fat composed of approximately 4% $C_{14}$, 31% $C_{16}$, 59% $C_{18}$.

Examples of suitable carboxylic acids (and their anhydrides) for preparing these nitrogen compounds include cyclo-hexane dicarboxylic acid, cyclohexene dicarboxylic acid, cyclopentane dicarboxylic acid and the like. Generally these acids will have about 5–13 carbon atoms in the cyclic moiety. Preferred acids useful in the present invention are benzene dicarboxylic acids such as phthalic acid, or its anhydride which is particularly preferred.

It is preferred that the nitrogen containing compound have at least one ammonium salt, amine salt or amide group. The particularly preferred amine compound is that amide-amine salt formed by reacting 1 molar portion of phthalic anhydride with 2 molar portions of di-hydrogenated tallow amine. Another preferred embodiment is the diamide formed by dehydrating this amide-amine salt.

The long chain ester copolymers used as additives according to this invention, may be used with one or both of the coadditive types mentioned above and may be mixed with either in ratios of 20/1 to 1/20 (w/w), more preferably 10/1 to 1/10 (w/w), most preferably 4/1 to 1/4. A ternary mixture may also be used in the ratio of long chain ester to coadditive 1 to coadditive 2 of x/y/z respectively where x, y and z may lie in the range of 1 to 20 but more preferably in the range of 1 to 10 and most preferably in the range of 1 to 4.

The additive systems of the present invention may conveniently be supplied as concentrates in oil for incorporation into the bulk distillate fuel. These concentrates may also contain other additives as required. These concentrates preferably contain from 3 to 80 wt.%, more preferably 5 to 70 wt.%, most preferably 10 to 60 wt.% of the additives preferably in solution in oil. Such concentrates are also within the scope of the present invention. The additives are generally used in an amount from 0.0001 to 5 more preferably 0.001 to 2 wt.% additive based on the fuel.

The present invention is illustrated by the following Examples in which the effectiveness of the additives of the present invention as pour point depressants and filterability improvers were compared with other additives in the following tests.

Tests

By one method, the response of the oil to the additives was measured by the Cold Filter Plugging Point Test (CFPPT) which is carried out by the procedure described in detail in "Journal of the Institute of Petroleum", Volume 521, Number 510, June 1966, pp. 173–185. This test is designed to correlate with the cold flow of a middle distillate in automotive diesels.

In brief, a 40 ml sample of the oil to be tested is cooled in a bath which is maintained at about −34° C. to give non-linear cooling at about 1° C./min. Periodically (at each one degree Centigrade drop in temperature starting from at least 2° C. above the cloud point) the cooled oil is tested for its ability to flow through a fine screen in a prescribed time period using a test device which is a pipette to whose lower end is attached an inverted funnel which is positioned below the surface of the oil to be tested. Stretched across the mouth of the funnel is a 350 mesh screen having an area defined by a 12 millimeter diameter. The periodic tests are each initiated by applying a vacuum to the upper end of the pipette whereby oil is drawn through the screen up into the pipette to a mark indicating 20 ml of oil. After each successful passage the oil is returned immediately to the CFPP tube.

The test is repeated with each one degree drop in temperature until the oil fails to fill the pipette within 60 seconds. This temperature is reported as the CFPP temperature. The difference between the CFPP of an additive free fuel and of the same fuel containing additive is reported as the CFPP depression by the additive. A more effective additive flow improver gives a greater CFPP depression at the same concentration of additive.

Another determination of flow improver effectiveness is made under conditions of the Programmed Cooling Test for flow improved distillate operability (PCT test) which is a slow cooling test designed to correlate with the pumping of a stored heating oil. The cold flow properties of the described fuels containing the additives were determined by the PCT test as follows. 300 ml of fuel are cooled linearly at 1° C./hour to the test temperature and the temperature then held constant. After 2 hours at the test temperature, approximately 20 ml of the surface layer is removed by suction to prevent the test being influenced by the abnormally large wax crystals which tend to form on the oil/air interface during cooling. Wax which has settled in the bottle is dispersed by gentle stirring, then a CFPPT filter assembly is inserted. The tap is opened to apply a vacuum of 500 mm of mercury, and closed when 200 ml of fuel have passed through the filter into the graduated receiver, A PASS is recorded if the 200 ml are collected within ten seconds through a given mesh size or a FAIL if the flow rate is too slow indicating that the filter has become blocked. CFPPT filter assemblies with filter screens of 20, 30, 40, 60, 80, 100, 120, 150, 200, 250 and 350 mesh number are used to determine the finest mesh (largest mesh number) the fuel will pass. The larger the mesh number that a wax containing fuel will pass, the smaller are the wax crystals and the greater the effectiveness of the additive flow improver. It should be noted that no two fuels will give exactly the same test results at the same treatment level for the same flow improver additive.

The cloud point of distillate fuels was determined by the standard Cloud Point Test (IP-219 or ASTM-D 2500) and the Wax Appearance Temperature estimated by measuring against a reference sample of Kerosene but without correcting for thermal lag by differential scanning calorimetry using a Mettler TA 2000B differential scanning calorimeter. In the Calorimeter test a 25 microliter sample of the fuel is cooled from a temperature at least 10° C. above the expected cloud point at a cooling rate of 2° C. per minute and the cloud point of the fuel is estimated as the wax appearance temperature as indicated by the differential scanning calorimeter plus 6° C.

EXAMPLES

Fuels

The fuels used in these examples were:

| | I | II | III | IV | V |
|---|---|---|---|---|---|
| FUEL | | | | | |
| Cloud Point* | +4 | +9 | +8 | +14 | +3 |
| Wax Appearance Point* | +3 | +3 | +7 | +13 | +1 |
| Wax Appearance °C. Temperature * | 0 | −0.3 | +2.6 | +8.2 | −3.9 |
| ASTM D-86 Distillation* | | | | | |
| Initial Boiling Point | 196 | 182 | 176 | 180 | 188 |
| 10% | | | | | |
| 20% | 223 | 234 | 228 | 231 | 236 |
| 50% | 272 | 275 | 276 | 289 | 278 |
| 90% | 370 | 352 | 360 | 385 | 348 |
| Final Boiling Point | 395 | 383 | 392 | 419 | 376 |
| Range of n-paraffin in the fuel** | 10–35 | 10–36 | 9–36 | 9–38 | 11–30 |

*Values in degrees Celcius
**As measured by capillary Gas-Liquid Chromatography

Additives Used

Ester copolymers of the Invention

The following straight chain di-n-alkyl fumarates were copolymerized with vinyl acetate (in a 1/1 molar ratio).

| Polymer | n-alkyl chain length |
|---|---|
| A1 | 10 |
| A2 | 12 |
| A3 | 14 |
| A4 | 16 |
| A5 | 18 |
| A6 | 20 |

The following (1/1 (w/w)) binary-esters were prepared by mixing two alcohols with the chain lengths set out below prior to esterification with fumaric acid. Copolymerisation was then performed with vinyl acetate (in a 1/1 molar ratio).

| Polymer | n-alkyl chain lengths |
|---|---|
| B1 | 10/12 |
| B2 | 12/14 |
| B3 | 14/16 |
| B4 | 16/18 |
| B5 | 18/20 |

Two fumarate-vinyl acetate copolymers were made from fumarate esters esterified with an alcohol mixture containing a range of chain lengths. The alcohols were first mixed esterified with fumaric acid and polymerised with vinyl acetate (1/1 molar ratio) to give products similar to that of Polymer A of United Kingdom Pat. No. 1469016.

| | n-alkyl chain lengths | | | | | |
|---|---|---|---|---|---|---|
| Polymer | 8 | 10 | 12 | 14 | 16 | 18 |
| C1 | 9 | 11 | 36 | 30 | 10 | 4 |
| C2 | 10 | 7 | 47 | 17 | 8 | 10 |

Values are in %(w/w) of alcohols containing the n-alkyl chains in the mixture. The average carbon numbers are 12.8 and 12.6 respectively.

A fumarate-vinyl acetate copolymer was made by first making a series of fumarates. The set of fumarates were then mixed prior to polymerization with vinyl acetate in a ratio of 5/2 (w/w) in a similar manner to Example Polymer E in UK Pat. No. 1469016 to give Polymer D as follows.

| | n-alkyl chain lengths of fumarates | | | | | | |
|---|---|---|---|---|---|---|---|
| Polymer | 6 | 8 | 10 | (12 | 14)* | (16 | 18)** |
| D | 4.2 | 6.2 | 7.3 | 38.6 | | 43.7 | |

*From Coconut Oil Alcohols $C_{12}/C_{14}$ ratio approx 3/3 (w/w)
**Tallow, Fumarate $C_{16}/C_{18}$ ratio approx 1/2 (w/w) Values are in % (w/w).

The average carbon number of Polymer D is 13.9.

Short-chain Ester Copolymers

Ethylene-vinyl acetate copolymers with the following properties were used as co-additives.

| Polymer | VA* | Mn** |
|---|---|---|
| E1 | 17.6 | 2210 |
| E2 | 24.6 | 3900 |
| E3 | 36 | 2500 |
| E4 | 16 | 3500 |
| E5 | (3/3 (w/w) mixture of E3/E4) | |

*Vinyl acetate content in % (w/w)
**Number Average Molecular Weight by Vapour Phase Osmometry

Polar nitrogen-containing compound

Compound F was prepared by mixing one molar proportion of phthalic anhydride with two molar proportions of di-hydrogenated tallow amine at 60° C. The dialkyl-ammonium salts of 2-N,N dialkylamido benzoate is formed.

Test in Fuels

The additive blends and the cold flow testing results are summarized in the following tables in which concentration is in Parts Per Million additive in the fuel.

CFPP Depressions if the CFPP of the treated fuel in °C. below that of the untreated fuel.

The PCT Values are the mesh number passed at −9° C., the higher the number the better the pass.

The following table shows the effect of fumarate-vinyl acetate copolymers of specific n-alkyl chain lengths in Fuel I.

| Additive | Concentration (ppm in Fuel) | CFPP | CFPP Depression | PCT |
|---|---|---|---|---|
| E5 | 175 | −6 | 6 | 200 |
| E5 | 300 | −12 | 12 | 200 |
| A1 | 175 | 0 | 0 | 40 |
| A1 | 300 | 0 | 0 | 60 |
| A2 | 175 | 0 | 0 | 60 |
| A2 | 300 | 0 | 0 | 60 |
| A3 | 175 | −8 | 8 | 250 |
| A3 | 300 | −10 | 10 | 250 |
| A4 | 175 | −1 | 1 | 60 |
| A4 | 300 | −3 | 3 | 60 |
| A5 | 175 | +1 | −1 | 30 |
| A5 | 300 | +1 | −1 | 30 |
| A6 | 175 | 0 | 0 | 30 |
| A6 | 300 | +1 | −1 | 40 |

Optimum potency is therefore observed with $C_{14}$ alkyl group in the fumarate.

TABLE 2

The effect of fumarate-vinyl acetate copolymers of specific n-alkyl chain lengths when used with an ethylene-vinyl acetate copolymer (ratio of 1/4 (w/w) respectively) in Fuel I was found to be as follows:

| Additive | Total Concentration (ppm in Fuel) | CFPP | CFPP Depression | PCT |
|---|---|---|---|---|
| E5 + A1 | 175 | −2 | 2 | 250 |
| E5 + A1 | 300 | −10 | 10 | 250 |
| E5 + A2 | 175 | −3 | 3 | 250 |
| E5 + A2 | 300 | −9 | 9 | 250 |
| E5 + A3 | 175 | −17 | 17 | 350 |
| E5 + A3 | 300 | −21 | 21 | 350 |
| E5 + A4 | 175 | −13 | 13 | 80 |
| E5 + A4 | 300 | −12 | 12 | 100 |
| E5 + A5 | 175 | −4 | 4 | 250 |
| E5 + A5 | 300 | −6 | 6 | 250 |
| E5 + A6 | 175 | −11 | 11 | 250 |
| E5 + A6 | 300 | −6 | 6 | 250 |

Optimum potency is again observed with $C_{14}$ alkyl group in the fumarate.

TABLE 3

The Effect of fumarate-vinyl acetate copolymers of specific n-alkyl chain lengths when combined with an ethylene-vinyl acetate copolymer as a coadditive (ratio of 1/4 (w/w) respectively) in Fuel II was found to be as follows:

| Additive | Total Concentration (ppm in Fuel) | CFPP | CFPP Depression | PCT |
|---|---|---|---|---|
| E5 + A1 | 175 | −9 | 9 | 60 |
| E5 + A1 | 300 | −10 | 10 | 100 |
| E5 + A2 | 175 | −8 | 8 | 60 |
| E5 + A2 | 300 | −10 | 10 | 100 |
| E5 + A3 | 175 | −15 | 15 | 80 |
| E5 + A3 | 300 | −17 | 17 | 200 |
| E5 + A4 | 175 | 0 | 0 | 80 |
| E5 + A4 | 300 | −3 | 3 | 80 |
| E5 + A5 | 175 | −9 | 9 | 60 |
| E5 + A5 | 300 | −10 | 10 | 100 |
| E5 + A6 | 175 | −9 | 9 | 80 |
| E5 + A6 | 300 | −10 | 10 | 100 |

Optimum potency is therefore again observed at $C_{14}$ alkyl group in the fumarate.

TABLE 4

The effect of fumarate-vinyl acetate copolymers made from neighbouring binary blends of alcohols when used with an ethylene-vinyl acetate copolymer (ratio of 1/4 (w/w) respectively) in Fuel I was found to be as follows:

| Additive | Average Carbon Number of n-alkyl chains on B series | Total Concentration (ppm in Fuel) | CFPP | CFPP Depression | PCT |
|---|---|---|---|---|---|
| E5 + B1 | 11 | 175 | −10 | 10 | 250 |
| E5 + B1 | 11 | 300 | −14 | 14 | 250 |
| E5 + B2 | 13 | 175 | −14 | 14 | 250 |
| E5 + B2 | 13 | 300 | −17 | 17 | 250 |
| E5 + B3 | 15 | 175 | −19 | 19 | 350 |
| E5 + B3 | 15 | 300 | −21 | 21 | 350 |
| E5 + B4 | 17 | 175 | −7 | 7 | 100 |
| E5 + B4 | 17 | 300 | −8 | 8 | 100 |

Here optimum potency is observed at $C_{15}$ alkyl group in the fumarate.

TABLE 5

The effect of fumarate-vinyl acetate copolymers when used with an ethylene-vinyl acetate copolymer (ratio of 1/4 (w/w) respectively) in Fuel III was found to be as follows:

| Additive | Average Carbon Number of n-alkyl chains on A & B series | Total Concentration (ppm in Fuel) | CFPP | CFPP Depression |
|---|---|---|---|---|
| E5 | — | 300 | 0 | 3 |
| E5 | — | 500 | −2 | 5 |
| E5 + A1 | 10 | 300 | +2 | 1 |

TABLE 5-continued

The effect of fumarate-vinyl acetate copolymers when used with an ethylene-vinyl acetate copolymer (ratio of 1/4 (w/w) respectively) in Fuel III was found to be as follows:

| Additive | Average Carbon Number of n-alkyl chains on A & B series | Total Concentration (ppm in Fuel) | CFPP | CFPP Depression |
|---|---|---|---|---|
| E5 + A1 | 10 | 500 | 0 | 3 |
| E5 + B1 | 11 | 300 | 0 | 3 |
| E5 + B1 | 11 | 500 | −1 | 4 |
| E5 + A2 | 12 | 300 | +2 | 1 |
| E5 + A2 | 12 | 500 | 0 | 3 |
| E5 + B2 | 13 | 300 | 0 | 3 |
| E5 + B2 | 13 | 500 | −1 | 4 |
| E5 + A3 | 14 | 300 | −10 | 14 |
| E5 + A3 | 14 | 500 | −14 | 17 |
| E5 + B3 | 15 | 300 | −14 | 17 |
| E5 + B3 | 15 | 500 | −13 | 16 |
| E5 + A4 | 16 | 300 | 0 | 3 |
| E5 + A4 | 16 | 500 | −10 | 13 |
| E5 + B4 | 17 | 300 | −2 | 5 |
| E5 + B4 | 17 | 500 | −3 | 6 |
| E5 + A5 | 18 | 300 | +3 | 0 |
| E5 + A5 | 18 | 500 | −1 | 4 |

Optimum potency observed at $C_{14}/C_{15}$ alkyl group in the fumarate.

TABLE 6

The effect of fumarate-vinyl acetate copolymers with ethylene-vinyl acetate copolymers (ratio of 1/4 (w/w) respectively) in Fuel IV were found to be as follows:

| Additive | Average Carbon Number of n-alkyl chains on A & B series | Total Concentration | CFPP | CFPP Depression |
|---|---|---|---|---|
| E5 | — | 300 | +5 | 5 |
| E5 | — | 500 | +5 | 5 |
| E5 + A1 | 10 | 300 | +5 | 5 |
| E5 + A1 | 10 | 500 | +5 | 5 |
| E5 + B1 | 11 | 300 | +6 | 4 |
| E5 + B1 | 11 | 500 | +5 | 5 |
| E5 + A2 | 12 | 300 | +5 | 5 |
| E5 + A2 | 12 | 500 | +4 | 6 |
| E5 + B2 | 13 | 300 | +5 | 5 |
| E5 + B2 | 13 | 500 | +5 | 5 |
| E5 + A3 | 14 | 300 | +6 | 5 |
| E5 + A3 | 14 | 500 | +5 | 5 |
| E5 + B3 | 15 | 300 | −9 | 4 |
| E5 + B3 | 15 | 500 | −11 | 5 |
| E5 + A4 | 16 | 300 | −5 | 15 |
| E5 + A4 | 16 | 500 | −10 | 20 |
| E5 + B4 | 17 | 300 | +5 | 5 |
| E5 + B4 | 17 | 500 | +3 | 7 |
| E5 + A5 | 18 | 300 | +6 | 4 |
| E5 + A5 | 18 | 500 | +2 | 8 |

Optimum potency was again observed at $C_{14}/C_{15}$ alkyl group in the fumarate.

TABLE 7

The effect of fumarate-vinyl acetate copolymers with ethylene-vinyl acetate copolymer (ratio of 1/1 (w/w) respectively) in Fuel III was found to be as follows and compared with the ethylene/vinyl acetate copolymers on their own.

| Additive | Total Concentration | CFPP | CFPP Depression |
|---|---|---|---|
| E1 | 300 | −7 | 10 |
| E2 | 300 | +1 | 2 |
| E5 | 300 | −1 | 4 |
| E1 + A3 | 300 | −11 | 14 |
| E1 + C1 | 300 | 0 | 3 |
| E1 + C2 | 300 | +1 | 2 |
| E1 + D | 300 | −5 | 8 |
| E2 + A3 | 300 | −11 | 14 |
| E2 + C1 | 300 | +2 | 1 |
| E2 + C2 | 300 | +1 | 2 |
| E2 + D | 300 | −5 | 8 |
| E5 + A3 | 300 | −10 | 14 |
| E5 + C1 | 300 | +2 | 1 |

TABLE 7-continued

The effect of fumarate-vinyl acetate copolymers with ethylene-vinyl acetate copolymer (ratio of 1/1 (w/w) respectively) in Fuel III was found to be as follows and compared with the ethylene/vinyl acetate copolymers on their own.

| Additive | Total Concentration | CFPP | CFPP Depression |
|---|---|---|---|
| E5 + C2 | 300 | 1 | 4 |
| E5 + D | 300 | 5 | 8 |

TABLE 9

The effect of the triple component additive combination comprising the fumarate-vinyl acetate copolymer, the ethylene-vinyl acetate copolymer and the polar nitrogen compound in Fuel V was found to be as follows:

| Additive | Total combination concentration | CFPP | CFPP Depression | PCT |
|---|---|---|---|---|
| E5 + A3 | 4/1 375 | −13 | 12 | 120 |
| E5 + A3 | 4/1 625 | −15 | 14 | 200 |
| E5 + A3 + F | 4/1/1 375 | −15 | 14 | 250 |
| E5 + A3 + F | 4/1/1 625 | −16 | 15 | 250 |

TABLE 10

The effect of various double and triple component additive combinations in Fuel I was found to be as follows:

| Additive | Total combination - Concentration | | CFPP Depression | PCT |
|---|---|---|---|---|
| E5 | — | 175 | 6 | 200 |
| E5 | — | 300 | 12 | 200 |
| E5 + A3 | 4/1 | 175 | 17 | 350 |
| E5 + A3 | 4/1 | 300 | 21 | 350 |
| E5 + A3 + F | 4/1/1 | 175 | 19 | 350 |
| E5 + A3 + F | 4/1/1 | 300 | 22 | 350 |

TABLE 11

The effect of fumarate-vinyl acetate copolymers of specific n-alkyl chain lengths on the Pour Point of Fuel III was found to be as follows:

| Additive | Concentration | Pour Point | Pour Point Depression |
|---|---|---|---|
| A2 | 500 | +3 | 0 |
| A3 | 500 | −15 | 18 |
| A4 | 500 | −9 | 12 |
| A5 | 500 | −9 | 12 |
| None | — | +3 | — |

Pour Point is measured by the ASTM D-97 Test.

The effect of the additives of the present invention on the Wax Appearance Temperature of the Fuels I to V used previously was determined and compared with other additives outside the scope of the invention.

FUEL IV

| Additive | Quantity ppm | Change in Wax Appearance Temperature |
|---|---|---|
| $C_{10}$ Fumarate/Vinyl Acetate Copolymer | 500 | −0.4° C. |
| $C_{12}$ Fumarate/Vinyl Acetate Copolymer | 500 | −0.5° C. |
| $C_{14}$ Fumarate/Vinyl Acetate Copolymer | 500 | −0.4° C. |
| $C_{16}$ Fumarate/Vinyl Acetate Copolymer | 500 | −2.6° C. |
| $C_{18}$ Fumarate/Vinyl Acetate Copolymer | 500 | −3.6° C. |
| $C_{20}$ Fumarate/Vinyl Acetate Copolymer | 500 | −1.4° C. |

FUEL III

| Additive | Quantity ppm | Change in Wax Appearance Temperature |
|---|---|---|
| $C_{10}$ Fumarate/Vinyl Acetate Copolymer | 500 | 0.4° C. |
| $C_{12}$ Fumarate/Vinyl Acetate Copolymer | 500 | 0.2° C. |
| $C_{14}$ Fumarate/Vinyl Acetate Copolymer | 500 | 0.2° C. |
| $C_{16}$ Fumarate/Vinyl Acetate Copolymer | 500 | −4.1° C. |
| $C_{18}$ Fumarate/Vinyl Acetate Copolymer | 500 | −3.3° C. |
| $C_{20}$ Fumarate/Vinyl Acetate Copolymer | 500 | −1.1° C. |

FUEL V

| Additive | Quantity ppm | Change in Wax Appearance Temperature |
|---|---|---|
| $C_{10}$ Fumarate/Vinyl Acetate Copolymer | 625 | +0.1° C. |
| $C_{12}$ Fumarate/Vinyl Acetate Copolymer | 625 | 0° C. |
| $C_{14}$ Fumarate/Vinyl Acetate Copolymer | 625 | −0.9° C. |
| $C_{16}$ Fumarate/Vinyl Acetate Copolymer | 625 | −3.3° C. |
| $C_{18}$ Fumarate/Vinyl Acetate Copolymer | 625 | −1.5° C. |
| $C_{20}$ Fumarate/Vinyl Acetate Copolymer | 625 | −0.1° C. |

FUEL II

| Additive | Quantity ppm | Change in Wax Appearance Temperature |
|---|---|---|
| $C_{10}$ Fumarate/Vinyl Acetate Copolymer | 300 | +0.5° C. |
| $C_{12}$ Fumarate/Vinyl Acetate Copolymer | 300 | +0.1° C. |
| $C_{14}$ Fumarate/Vinyl Acetate Copolymer | 300 | +0.4° C. |
| $C_{16}$ Fumarate/Vinyl Acetate Copolymer | 300 | −2.8° C. |
| $C_{18}$ Fumarate/Vinyl Acetate Copolymer | 300 | −1.6° C. |
| $C_{20}$ Fumarate/Vinyl Acetate Copolymer | 300 | −0.2° C. |

FUEL I

| Additive | Quantity ppm | Change in Wax Appearance Temperature |
|---|---|---|
| $C_{10}$ Fumarate/Vinyl Acetate Copolymer | 300 | −0.3° C. |
| $C_{12}$ Fumarate/Vinyl Acetate Copolymer | 300 | −0.3° C. |
| $C_{14}$ Fumarate/Vinyl Acetate Copolymer | 300 | +1.2° C. |
| $C_{16}$ Fumarate/Vinyl Acetate Copolymer | 300 | −5.0° C. |
| $C_{18}$ Fumarate/Vinyl Acetate Copolymer | 300 | −3.3° C. |
| $C_{20}$ Fumarate/Vinyl Acetate Copolymer | 300 | −1.8° C. |

Thus showing in almost all instances illustrates a peak of cloud point depressing activity at around the $C_{16}$ alkyl group in the fumarate ester.

We claim:

1. A petroleum distillate boiling in the range 120° C. to 500° C. and having a final boiling point equal to or greater than 370° C. with a 90% boiling point above 350° C., containing from 0.001% to 2% by weight of (A) a polymer consisting essentially of polyester comprising mono or di-n-alkyl ester of mono-ethylenically unsaturated $C_4$ to $C_8$ mono or dicarboxylic acid or anhydride containing at least 25 wt. % of n-alkyl groups containing an average of from 14 to 18 carbon atoms and no more than 10% (w/w) of said alkyl groups containing fewer than 14 carbon atoms and no more than 10% (w/w) of the alkyl groups contain more than 18 carbon atoms copolymerized with 0 to 70 mole % of ester of the formula:

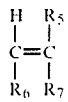

wherein $R_5$ is hydrogen or a $C_1$ to $C_4$ alkyl group, $R_6$ is

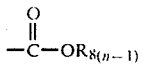

or

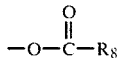

where $R_8$ is $C_1$ to $C_5$ alkyl and $R_7$ is $R_6$ or hydrogen.

2. A petroleum distillate according to claim 1 in which (A) is the copolymer of vinyl acetate and a di-n-alkyl fumarate.

3. A petroleum distillate according to claim 1 also containing a cold temperature flow improver (B) which is a copolymer of ethylene with unsaturated ester of the general formula:

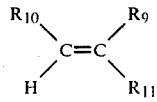

wherein $R_{10}$ is hydrogen or methyl, $R_9$ is selected from the group consisting of (a)

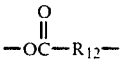

groups wherein $R_{12}$ is hydrogen or a $C_1$ to $C_{17}$ alkyl group; and (b) —$COOR_{12}$ groups wherein $R_{12}$ is a $C_1$ to $C_{17}$ alkyl group.

4. A petroleum distillate according to claim 3 in which the cold temperature flow improver (B) is a copolymer of ethylene and a vinyl ester of a $C_1$ to $C_4$ carboxylic acid.

5. A petroleum distillate according to claim 1 also containing (C) a polar nitrogen containing compound of 30 to 300 carbon atoms, having at least one straight chain $C_8$ to $C_{40}$ alkyl segment, which are amine salts or amides formed by reaction of a molar proportion of $C_{12}$ to $C_{40}$ amine with a molar proportion of hydrocarbyl acid having 1 to 4 carboxylic acid groups or their anhydrides.

6. A petroleum distillate according to claim 1, wherein said final boiling point is in the range of 370° C. to 410° C. and the cloud point is in the range of −5° C. to +10° C., and wherein said average is between 14 and 17 carbon atoms.

7. A petroleum distillate according to claim 1, wherein said final boiling point is in excess of 400° C. and the cloud point is above 10° C. and wherein said average is between 16 and 18 carbon atoms.

8. A petroleum distillate according to claim 2, wherein (A) is a copolymer of 40 to 60 mole % of dialkyl fumerate with 60 to 40 mole % of vinyl acetate, said copolymer (A) having a number average molecular weight in the range of 1000 to 100,000.

9. A petroleum distillate according to claim 4, wherein (B) is copolymer consisting essentially of ethylene and 10 to 40 wt. % vinyl acetate, said copolymer (B) having number average molecular weights of 1000 to 6000.

10. A petroleum distillate according to claim 5, wherein (C) is a reaction product of a molar portion of phthalic anhydride with two molar portions of di-hydrogenated tallow amine.

11. A petroleum distillate according containing a cold flow improving amount within the range of 0.001 to 2 wt. % additive which is a mixture of (A) copolymer of dialkyl fumerate and vinyl acetate, (B) copolymer consisting essentially of ethylene and vinyl acetate, and (C) the reaction product of a molar proportion of phthalic anhydride with two molar portions of di-hydrogenated tallow amine; in a relative amount of 1 to 20 parts of each of (A), (B) and (C).

12. A petroleum distillate oil according to claim 1, wherein the amount of said additive (A) is sufficient to decrease the wax appearance point and the cloud point of said oil by at least 1° C.

13. A petroleum distillate oil according to claim 2, wherein the amount of said additive (A) is sufficient to decrease the wax appearance point and the cloud point of said oil by at least 1° C.

14. A petroleum distillate oil according to claim 6, wherein the amount of said additive (A) is sufficient to decrease the wax appearance point and the cloud point of said oil by at least 1° C.

15. A petroleum distillate oil according to claim 7, wherein the amount of said additive (A) is sufficient to decrease the wax appearance point and the cloud point of said oil by at least 1° C.

16. A petroleum distillate oil according to claim 8, wherein the amount of said additive (A) is sufficient to decrease the wax appearance point and the cloud point of said oil by at least 1° C.

17. A method of decreasing the wax appearance point and/or cloud point of a petroleum distillate oil being in the range 120° C. to 500° C. having a final boiling point equal to or greater than 370° C., with a 90% boiling point above 350° C., comprising adding from 0.001% to 2% by weight of (A) a polymer or copolymer consisting essentially of polyester comprising mono or di-n-alkyl ester of mono-ethylenically unsaturated $C_4$ to $C_8$ mono or dicarboxylic acid or anhydride containing at least 25 wt. % of n-alkyl groups containing an average of from 14 to 18 carbon atoms and no more than 10% (w/w) of said alkyl groups containing fewer than 14 carbon atoms and no more than 10% (w/w) of the alkyl groups contain more than 18 carbon atoms copolymerized with 0 to 70 mole % of ester of the formula:
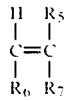
wherein $R_5$ is hydrogen or a $C_1$ to $C_4$ alkyl group, $R_6$ is
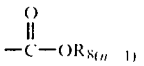
or
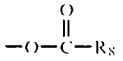
where $R_8$ is $C_1$ to $C_5$ alkyl and $R_7$ is $R_6$ or hydrogen.
* * * * *